US009593482B2

(12) United States Patent
Cipriani

(10) Patent No.: US 9,593,482 B2
(45) Date of Patent: Mar. 14, 2017

(54) BAR OF A SUPPORT STRUCTURE FOR A FALSE CEILING AND WORKING PROCESS FOR WORKING THE BAR

(71) Applicant: Giuseppe Cipriani, Rovereto (IT)

(72) Inventor: Giuseppe Cipriani, Rovereto (IT)

( * ) Notice: Subject to any disclaimer, the term of this patent is extended or adjusted under 35 U.S.C. 154(b) by 0 days.

(21) Appl. No.: 14/653,255

(22) PCT Filed: Mar. 7, 2014

(86) PCT No.: PCT/IB2014/059532

§ 371 (c)(1),
(2) Date: Jun. 17, 2015

(87) PCT Pub. No.: WO2014/136096

PCT Pub. Date: Sep. 12, 2014

(65) Prior Publication Data

US 2015/0361661 A1 Dec. 17, 2015

(30) Foreign Application Priority Data

Mar. 8, 2013 (IT) ..... VR2013A0058

(51) Int. Cl.
*E04B 9/06* (2006.01)

(52) U.S. Cl.
CPC ..... *E04B 9/068* (2013.01); *E04B 9/06* (2013.01); *E04B 9/065* (2013.01); *E04B 9/067* (2013.01); *Y10T 83/02* (2015.04)

(58) Field of Classification Search
CPC . E04B 9/06; E04B 9/068; E04B 9/067; E04B 9/065; Y10T 83/02
See application file for complete search history.

(56) References Cited

U.S. PATENT DOCUMENTS 1,253,216 A 1/1918 Day
3,312,488 A 4/1967 Lickliter et al.
(Continued)

FOREIGN PATENT DOCUMENTS

AU 4226878 6/1979
DE 4431849 A1 3/1996
(Continued)

OTHER PUBLICATIONS

PCT International Search Report mailed on May 13, 2014 for PCT/IB2014/059535 filed on Mar. 7, 2014 in the name of Giuseppe Cipriani.
(Continued)

*Primary Examiner* — Andrew J Triggs
(74) *Attorney, Agent, or Firm* — Steinfl + Bruno LLP

(57) ABSTRACT

A bar of a support structure for a false ceiling is described. The bar has an elongated shape along a longitudinal direction and includes at least two sheet metal portions located side by side or overlapped, in contact or adherent, with each other along said longitudinal direction, or short side direction. In the bar a transverse direction, or short-side direction, extending transverse to, or intersecting, said longitudinal direction is defined. At least one of the sheet metal portions has cuts defining partially cut parts, wherein a partially cut part of said at least one of the sheet metal portions protrudes towards the other of said sheet metal portions in a thickness direction so as to determine an interference of parts in the thickness direction. The cuts are arranged, are directed, or extend along said transverse direction and the partially cut parts have, when viewed in perspective, an at least partially curvilinear or concave profile.

15 Claims, 17 Drawing Sheets

(56) References Cited

U.S. PATENT DOCUMENTS

| | | | | |
|---|---|---|---|---|
| 3,979,874 | A | 9/1976 | Cubbler, Jr. et al. | |
| 4,489,529 | A * | 12/1984 | Ollinger | E04B 9/068 52/506.07 |
| 4,658,502 | A | 4/1987 | Eckold et al. | |
| 5,271,202 | A | 12/1993 | Vukmanic et al. | |
| 5,577,313 | A | 11/1996 | Guido et al. | |
| 5,687,525 | A | 11/1997 | Koski et al. | |
| 5,979,055 | A | 11/1999 | Sauer et al. | |
| 6,047,511 | A | 4/2000 | Lehane et al. | |
| 6,138,416 | A | 10/2000 | Platt | |
| 6,523,314 | B1 | 2/2003 | LaLaonde et al. | |
| 7,762,034 | B2 * | 7/2010 | Jankovec | B21D 39/035 29/432.2 |
| 7,797,903 | B2 * | 9/2010 | Lehane, Jr. | E04B 9/068 52/506.07 |
| 8,590,248 | B2 | 11/2013 | Lehane, Jr. et al. | |
| 8,715,427 | B2 | 5/2014 | Vandeputte et al. | |
| 2003/0154686 | A1 | 8/2003 | Platt | |
| 2003/0200719 | A1 | 10/2003 | Koski et al. | |
| 2007/0028554 | A1 | 2/2007 | Ferrell et al. | |
| 2008/0245018 | A1 * | 10/2008 | Miller | E04B 9/061 52/506.07 |
| 2010/0077687 | A1 | 4/2010 | Jankovec et al. | |
| 2015/0121800 | A1 * | 5/2015 | Cipriani | E04B 9/10 52/848 |

FOREIGN PATENT DOCUMENTS

| | | | |
|---|---|---|---|
| DE | 10211257 | A1 | 9/2003 |
| EP | 0940514 | | 9/1999 |
| EP | 1239095 | A2 | 9/2002 |
| EP | 1762663 | | 3/2007 |
| EP | 2447434 | A1 | 5/2012 |
| EP | 2532799 | A1 | 5/2015 |
| GB | 1369234 | A | 10/1974 |
| GB | 2133819 | | 8/1984 |
| GB | 2145752 | | 4/1985 |
| GB | 2274080 | | 7/1994 |
| WO | 99/46460 | A1 | 9/1999 |
| WO | 2007/039542 | A1 | 4/2007 |
| WO | 2012/118223 | A1 | 9/2012 |
| WO | 2013/068937 | | 5/2013 |
| WO | 2013/175268 | A1 | 11/2013 |
| WO | 2014/016648 | | 1/2014 |
| WO | 2014/016648 | A1 | 1/2014 |

OTHER PUBLICATIONS

PCT Written Opinion mailed on May 13, 2014 for PCT/IB2014/059535 filed on Mar. 7, 2014 in the name of Giuseppe Cipriani.

PCT International Preliminary Report on Patentability mailed on Apr. 17, 2015 for PCT/IB2014/059535 filed on Mar. 7, 2014 in the name of Giuseppe Cipriani.

PCT International Search Report mailed on May 13, 2014 for PCT/IB2014/058999 filed on Feb. 14, 2014 in the name of Giuseppe Cipriani.

PCT Written Opinion mailed on May 13, 2014 for PCT/IB2014/058999 filed on Feb. 14, 2014 in the name of Giuseppe Cipriani.

PCT International Preliminary Report on Patentability mailed on Apr. 29, 2014 for PCT/IB2014/058999 filed on Feb. 14, 2014 in the name of Giuseppe Cipriani.

PCT International Search Report mailed on Apr. 2, 2013 for PCT/IB2012/053862 filed on Jul. 27, 2012 in the name of Giuseppe Cipriani.

PCT Written Opinion mailed on Apr. 2, 2013 for PCT/IB2012/053862 filed on Jul. 27, 2012 in the name of Giuseppe Cipriani.

PCT International Preliminary Report on Patentability mailed on Dec. 12, 2014 for PCT/IB2012/053862 filed on Jul. 27, 2012 in the name of Giuseppe Cipriani.

Demeester, J. "To: Ms. Manfrin—Application of Cipriani Giuseppe—your ref BW74E-EMM-emm." Email to Marta Manfrin. Mar. 13, 2014. 1 page.

DOCOL—High Strength Steel. "Docol Roll—Cold rolled high strength steel for roll forming.". Apr. 9, 2011 2 pages.

First Office Action issued for Chinese Patent Application No. 201280059686.0 filed in Giuseppe Cipriani. 10 pgs. Mail date: Jul. 15, 2015 (Chinese original + English Translation) 10 pages.

Manfrin, M. "To: Ms. Manfrin—Application of Cipriani Giuseppe—your ref BW74E-EMM-emm." Email to Jan Demeester. Mar. 13, 2014. 4 pages.

Masaaki, M. et al. "Method for Bending Sheet Metal and Product of Sheet Metal." Translation of specification WO2012118223 (A1) published on Sep. 7, 2012. 52 pages.

Non/Final Office Action mailed on Feb. 23, 2015 for U.S. Appl. No. 14/354,546, filed Apr. 25, 2014 in the name of Guiseppe Cipriani. 13 pages.

Non/Final Office Action mailed on Nov. 3, 2015 for U.S. Appl. No. 14/653,263, filed Jun. 17, 2015 in the name of Guiseppe Cipriani. 15 pages.

Notice of Allowance mailed on Sep. 28, 2015 for U.S. Appl. No. 14/354,546, filed Apr. 25, 2014 in the name of Guiseppe Cipriani. 8 pages.

Office Action issued for Chilean Patent Application No. 1180-2014 filed in the name of Giuseppe Cipriani.. Date: Apr. 1, 2015 (English Summary + Original Office Action) 13 pages.

PCT International Preliminary Report on Patentability mailed on Apr. 10, 2014 for PCT/IB2012/056221 filed on Jul. 27, 2012 in the name of Giuseppe Cipriani. 36 pages.

PCT International Preliminary Report on Patentability mailed on Apr. 17, 2015 for PCT/IB2012/059532 filed on Mar. 7, 2014 in the name of Giuseppe Cipriani. 16 pages.

PCT International Search Report mailed on Jul. 12, 2013 for PCT/IB2012/056221 filed on Jul. 11, 2012 in the name of Giuseppe Cipriani. 4 pages.

PCT International Search Report mailed on Jul. 26, 2012 for PCT Application PCT/IB2011/055051 filed on Nov. 11, 2011 in the name of Giuseppe Cipriani. 4 pages.

PCT International Search Report mailed on May 13, 2014 for PCT/IB2012/059532 filed on Mar. 7, 2014 in the name of Giuseppe Cipriani. 4 pages.

PCT Written Opinion mailed on Dec. 2, 2013 for PCT Application PCT/IB2012/056221 filed on Nov. 7, 2012 in the name of Giuseppe Cipriani. 5 pages.

PCT Written Opinion mailed on Jan. 22, 2014 for PCT Application PCT/IB2012/056221 filed on Nov. 7, 2012 in the name of Giuseppe Cipriani. 8 pages.

PCT Written Opinion mailed on Jul. 12, 2013 for PCT Application PCT/IB2012/056221 filed on Nov. 7, 2012 in the name of Giuseppe Cipriani. 5 pages.

PCT Written Opinion mailed on Jul. 26, 2012 for PCT Application PCT/IB2011/055051 filed on Nov. 11, 2011 in the name of Giuseppe Cipriani. 5 pages.

PCT Written Opinion mailed on May 13, 2014 for PCT/IB2012/059532 filed on Mar. 7, 2014 in the name of Giuseppe Cipriani. 7 pages.

Response to Written Opinion dated Mar. 7, 2014 for PCT Application PCT/IB2012/056221 filed on Nov. 7, 2012 in the name of Giuseppe Cipriani. 44 pages.

Response to Written Opinion dated Nov. 14, 2013 for PCT Application PCT/IB2012/056221 filed on Nov. 7, 2012 in the name of Giuseppe Cipriani. 14 pages.

SSAB Swedish Steel Group. "It's All About Strength and Lightness." DOCOL. Aug. 2008. 32 pages.

World Auto Steel. Advanced High Strength Steel (AHSS) Application Guidelines. Version 4.1.. Jun. 8, 2009 338 pages.

Non-Final Office Action for U.S. Appl. No. 14/412,666, filed Mar. 5, 2015 on behalf of Giuseppe Cipriani. Mail Date: Nov. 27, 2015. 10 pages.

Notice of Allowance for U.S. Appl. No. 14/412,666, filed Mar. 5, 2015 on behalf of Giuseppe Cipriani. Mail Date: Apr. 20, 2016. 25 pages.

* cited by examiner

BAR OF A SUPPORT STRUCTURE FOR A FALSE CEILING AND WORKING PROCESS FOR WORKING THE BAR

CROSS REFERENCE TO RELATED APPLICATIONS

The present application is the US national stage of International Patent Application PCT/IB2014/059532 filed on Mar. 7, 2014 which, in turn, claims priority to Italian application VR2013A000058 filed on Mar. 8, 2013.

The present disclosure refers generally to support structures, or load-bearing structures, for false ceilings, i.e. support structures for sheets or panels placed underneath a regular ceiling and connected to the ceiling by means of a so-called hanger, steel rods, a wire, bars or other coupling articles.

Support structures for false ceilings comprise a support frame intended to support or retain panels or sheets, wherein the frame includes metal bars joined together and intersecting by means of a special joint so as to ideally form a grid, which defines a supporting plane for the panels or sheets of the false ceiling.

Even more particularly, the present disclosure refers to a metal bar and a working process for the metal bar.

It is known that a metal bar for support structures for false ceilings is an article of elongated shape having a T-shaped or a U-shaped or C-shaped section, or other T shapes, which is obtained by folding a metal sheet, so as to obtain overlapping of two sheet metal portions, such as to define sheet metal portions which are adjacent and/or located side by side.

In practice, the metal bar includes at least two sheet metal portions, or walls, located side by side and overlapped along a longitudinal direction, or short-side direction, of the bar.

It is also known that there is the need to use metal sheets for the manufacturing of metal bars that are made of a material which is as light as possible and of reduced thickness, so as to affect as little as possible the weight and the cost of the support structure.

However, the use of lightweight materials is often incompatible with the possibility of ensuring an adequate mechanical strength and stability performance of the metal bar on-site. In particular, it has been noted that a metal bar manufactured in the manner described above, wherein two sheet metal walls are longitudinally located side by side, is subject to torsion about a longitudinal axis when subjected to load. As can be understood, such a torsional tendency influences negatively the mechanical performance and the load applied to the bar itself.

The present disclosure is based on a recognition by the inventor, that the torsional tendency is mainly due to a tendency of the two sheet metal portions to slide relative to one another. Consequently, to reduce the torsional tendency and increase the stiffness of the bar in the longitudinal direction, the idea which has occurred is that of preventing sliding of the sheet metal parts.

Some solutions for joining together the two sheet metal portions could include bonding or welding. Such techniques are, however, very expensive and must be adapted from time to time to the type of bar being manufactured, i.e. to the shape, size and material of the metal bar.

Moreover the present disclosure is based on a recognition by the inventor that the two sheet metal portions, if not suitably connected together, may tend to become disengaged from each other and remain mutually spaced. In this condition of "disengagement", the bar is practically free during torsion, making ineffective any attempt to create friction or interference between the two sheet metal portions of the bar. Moreover the two sheet metal portions, since they are separated and connected only in the folding zone, are subject to possible relative movements.

The present disclosure stems from the technical problem of providing a metal bar for a false ceiling and a working process for working a metal bar which are able to overcome the drawbacks mentioned above in relation to the prior art and/or to achieve further advantages or features.

Such technical problem may be solved by means of a metal bar, a support structure for a false ceiling and a process as claimed.

Specific embodiments of the subject-matter of the present disclosure are set forth in the corresponding dependent claims.

In particular, the subject-matter of the present disclosure represents an improvement to a metal bar according to the international patent application PCT/IB2012/053862 dated 27 Jul. 2012, which is cited herein in its entirety by way of a reference.

In particular, according to some aspects of the present disclosure, in order to join or connect together the at least two sheet metal portions, a half cut is made in at least one of the sheet metal portions, such as to obtain half-cut parts of the two sheet metal portions wherein such half-cut parts may protrude, at least partially, in a thickness direction towards the other of the two sheet metal portions and create an interference. In practice, at least one of the two sheet metal portions has one or more pairs of cuts defining partially cut parts that, as a result of the cut, are partially cut and shifted towards the other sheet metal portion. More particularly both the sheet metal portions have cuts which are arranged, directed or extend in said transverse direction. Said cuts define partially cut parts which have, when viewed in perspective, a profile which is at least partially curvilinear or concave. Pairs of the partially cut parts are therefore overlapped and shifted in pairs in the thickness direction with respect to an adjacent zone of the respective sheet metal portion. Even more particularly, of each pair of parts overlapped and shifted in the thickness direction, a part of a sheet metal portion is protruding towards the outside with respect to said thickness and defines a free zone in said thickness and at least the concave or curved profile of the other partially cut part of the other of said sheet metal portions (5, 6) is arranged at least partially in said free zone of the thickness of the one sheet metal portion, creating an interference between the two sheet metal portions in the transverse direction.

Within the scope of the present disclosure, the term "half-cut" indicates a process such as to create in at least one sheet metal portion "partially cut parts", therefore parts partially joined to a remaining part of the bar, wherein an area joined with the remaining part of the bar—where in fact the half-cut part deforms with respect to the remaining part of the bar—defines a sort of hinge line or zone.

According to an aspect of the present disclosure, to counteract the bar torsion and to obtain a bar of satisfactory torsional rigidity, the cuts are arranged, or extend, along a transverse direction of the bar (or short-side direction), i.e. in a transverse direction with respect to the longitudinal direction (or long-side direction). A transverse direction, or short-side direction, may be orthogonal, or oblique with respect to the longitudinal direction of the bar, in fact it is a direction that "crosses" or "intersects" the longitudinal direction. The transverse direction may be understood as being a direction which is straight or with a wavy or curved progression.

In particular, the extension of the cuts in the transverse direction is such as to create an interference (so-called "anti-torsion" interference) between the sheet metal portions extending in said transverse direction. As mentioned above, such an interference of parts in said direction, has proved to be particularly effective for preventing or reducing torsion of the metal bar.

According to another aspect of the present disclosure, in order to counteract further torsion of the bar and obtain a bar of satisfactory torsional rigidity, the partially cut parts have, when viewed from the side of the bar thickness, namely when viewed in perspective or in vertical section, a curvilinear profile, namely a profile which is not linear and not straight.

The curvilinear profile may be felt when passing a finger over the outer surface of the profile along the zone of the half-cut parts.

As a result of the profile which is not linear and not straight, it is possible to obtain a further interference or clinching effect (so-called "anti-disengagement" interference) between the sheet metal portions in the thickness direction, said clinching effect occurring in a curved or folded zone of the partially cut part, and consequently a further connection between the sheet metal portions of the metal bar. In particular, the author of the present patent application has also found that with such a bar with half-cut parts having a curvilinear profile it is possible to obtain a stable engagement of the sheet metal portions and prevent accidental separation of the sheet metal portions during use.

Within the scope of present disclosure the term "curvilinear profile" is to be understood as meaning a profile which can be obtained by means a half-cut with a punch having a head with a profile which is not straight, for example V-shaped, W-shaped or with a concave C-shape, or with a variety of such profiles, in the transverse direction. Consequently, the half-cut parts, when observed viewing the thickness of the bar from one side, or obliquely, have a similar profile which is not straight, for example V-shaped, or W-shaped or with a concave C-shape, or has a variety of such profiles in the transverse direction.

The curvilinear profile may also have a sinusoidal profile. It is possible, therefore, to obtain both an "anti-torsion" effect between the sheet metal portions and an "anti-disengagement" effect between the sheet metal portions.

In particular the author of the present disclosure has recognized that, to obtain the aforementioned "anti-torsion" effect and "anti-disengagement" effect between the sheet metal portions, it is preferable to make at least three, or even better five, cuts in succession along the bar so as to obtain at least two, or four, half-cut parts, also called punched zones or points, in sequence along the bar.

In some embodiments, the cuts or the associated partially cut parts may be made in such a way that the projection towards the other of the sheet metal portions, and the relative interference, does not extend in the transverse direction over the entire height, or thickness, of the half-sheared part. In practice, the half-sheared part may protrude only partially towards the other sheet metal portion, for example, in the region of said hinge line area, or deformed area. In some embodiments, such hinge line area coincides with a corner area of the half-cut part.

In one embodiment, the cuts are made in pairs and staggered on opposite sides of the bar, so as to form pairs of partially cut and interfering parts of one and the other sheet metal portion, which alternate in the longitudinal direction. In practice, in some embodiments, each of the at least two sheet metal portions have pairs of adjacent cuts. The pairs of cuts are two by two staggered in said longitudinal direction and on opposite sides. Such cuts determine an alternate shifting in opposite directions of pairs of partially cut parts. This alternate shifting allows an increased interference between the parts to be obtained.

The pairs are therefore alternately shifted towards the one sheet metal portion and the other sheet metal portion. A sequence of half-cuts that defines an interference line or seam line is therefore performed.

In an alternative embodiment, the cuts are carried out on a single or same part of the bar, therefore only on one of the two sheet metal portions, so as to form pairs of alternating successive cuts on at least one of the two sheet metal portions, resulting in a partial cut or a deformation of the other sheet metal portion. It follows that, in this embodiment, the pairs of cuts are spaced by areas where there are no cuts.

The seam line may be a continuous or broken line. Several seam lines may also be provided.

In one embodiment, the cuts are made so as to have a depth at least equal to the thickness of the respective sheet metal portion.

In one embodiment, the cuts are made so as to have a depth less than half the thickness of the respective sheet metal portion.

In a further embodiment, the cuts are made so as to have a depth greater than half the thickness of the relative sheet metal portion, and enable a satisfactory interference to be obtained.

According to some aspects of the present disclosure, the aforementioned double "anti-torsion" and "anti-disengagement" effect may be obtained in any zone of the bar where the cuts are made.

For example in one embodiment of the present disclosure, the bar includes an integral engaging element located at one end of the bar and forming an integral part of the bar.

The cuts according to the present disclosure may be made in the integral engaging element so as to connect by means of mutual clinching the sheet metal portions which define the integral engaging element and prevent mutual separation and opening of the sheet metal portions which could result in the integral engaging element being unutilizable.

In accordance with some embodiments of the present disclosure, the bar is made of highly resistant material, as defined in the international patent application PCT/IB2012/056221 in the name of the same inventor of the present patent application and cited herein in its entirety by way of a reference.

With this material it is possible to obtain a bar for a false ceiling which has a very small thickness, for example below 0.25 mm and up to 0.10 mm, and at the same time a high strength which may withstand punching without undesirable deformations despite a small thickness. In other words, the inventor of the present patent application has realized that a steel bar having the aforementioned mechanical characteristics may be punched, despite having a small thickness, without the risk of deformations which may adversely affect the mechanical performance of the bar.

Other features and the modes of use of the subject of the present disclosure will become clear from the following detailed description of a number of preferred embodiments thereof, provided by way of a non-limiting example. It is clear, however, that each embodiment may have one or more of the advantages listed above; in any case it is not required that each embodiment should have simultaneously all the advantages listed.

Reference will be made to the figures of the annexed drawings, wherein.

Figure 1:
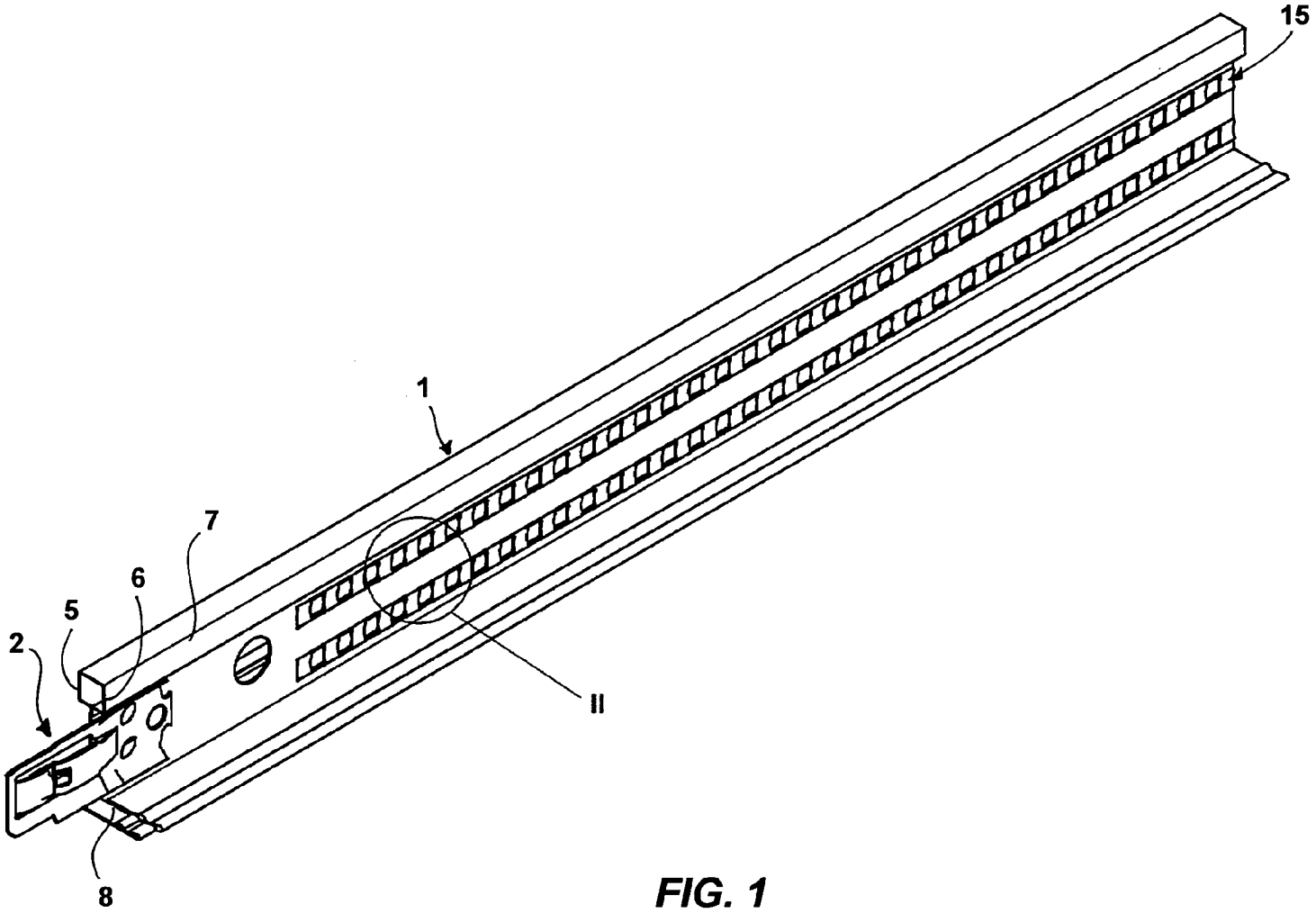
FIG. 1 shows a perspective view of a bar of a support structure for false ceilings, according to one embodiment of the present disclosure.

With reference to the attached figures, a bar for forming a frame of a support structure of a false ceiling according to some embodiments of the present disclosure is denoted by the reference number 1. The bar is adapted to be joined to another metal bar 1 by means of a clip 2 fixed to one end of the metal bar 1. For example, more particularly, the clip 2 may be inserted into a slot (not shown) of a second metal bar 1 to be engaged with an edge that defines the slot in the metal bar 1 so as to create a join between two metal bars 1.

In the example, the metal bar 1 has a T-shaped section and is obtained by folding a metal sheet, so as to obtain overlapping of at least two sheet metal portions 5, 6. The metal bar 1 may be different from the one illustrated, for example, with a different section, such as for example a C-shaped or U-shaped section, or even with a further different section/T-shape.

Figure 5:
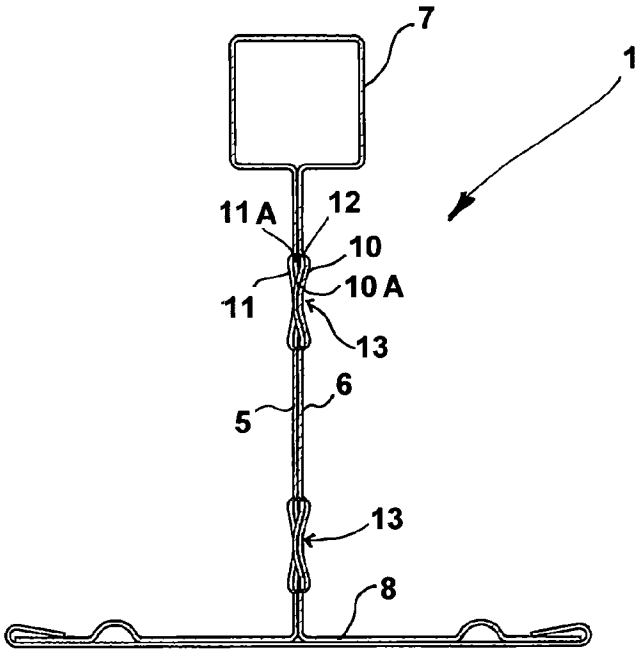
FIG. 5 shows a vertically sectioned view of a bar of a support structure for false ceilings, according to an embodiment of the present disclosure.
Figure 6:
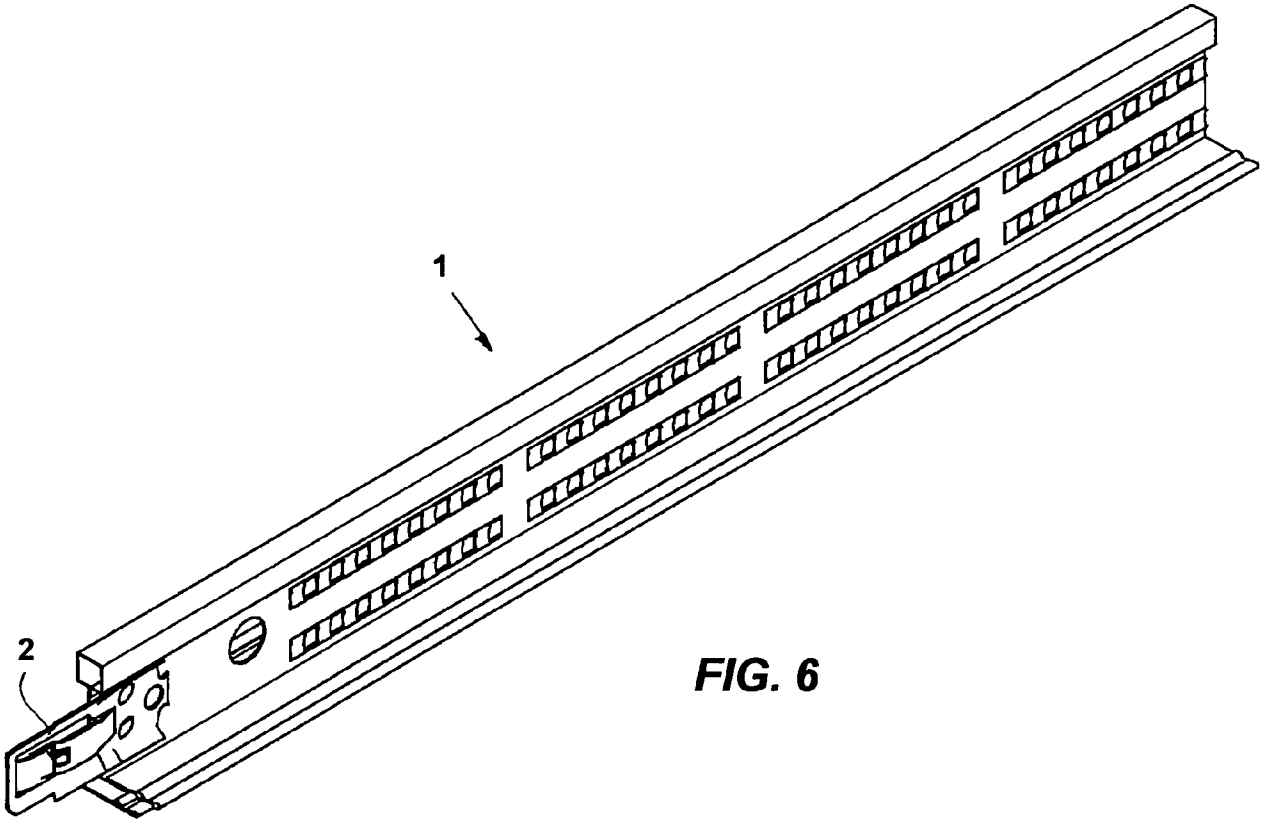
FIG. 6 shows a perspective view of a bar of a support structure for false ceilings, according to a further embodiment of the present disclosure.

What is important in the scope of the present disclosure is that the metal bar 1 should include at least two sheet metal portions 5, 6, or walls, located side by side and/or overlapped, as shown for example in FIG. 5. The two sheet metal portions 5, 6 may be adherent, i.e. in contact, with one another.

Figure 3:
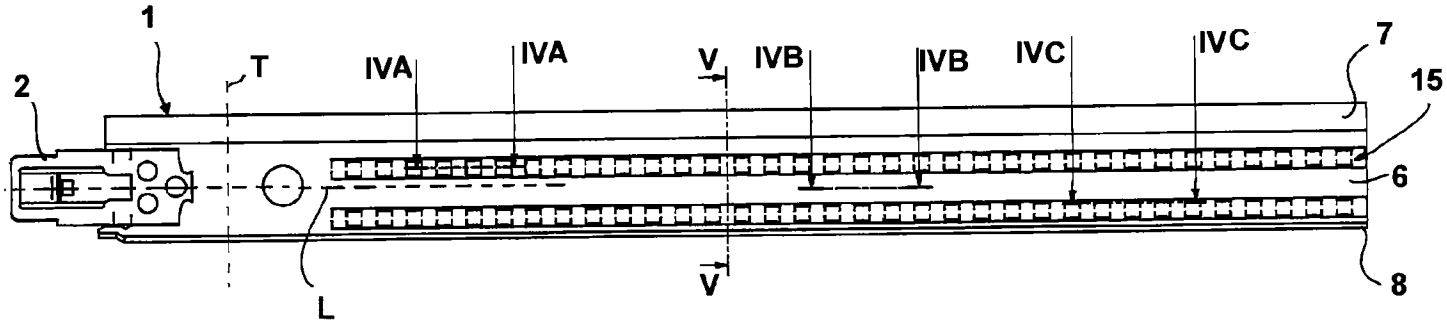
FIG. 3 shows a side view of a bar of a support structure for false ceilings, according to one embodiment of the present disclosure.

The metal bar 1 extends in a prevailing direction, also called longitudinal direction, which is indicated by a broken line in FIG. 3 and denoted by the reference letter L. In other words, the metal bar is an elongated body wherein a long side, extending in said longitudinal direction, and a short side, extending transversely with respect to the long side, are distinguished.

Figure 8:
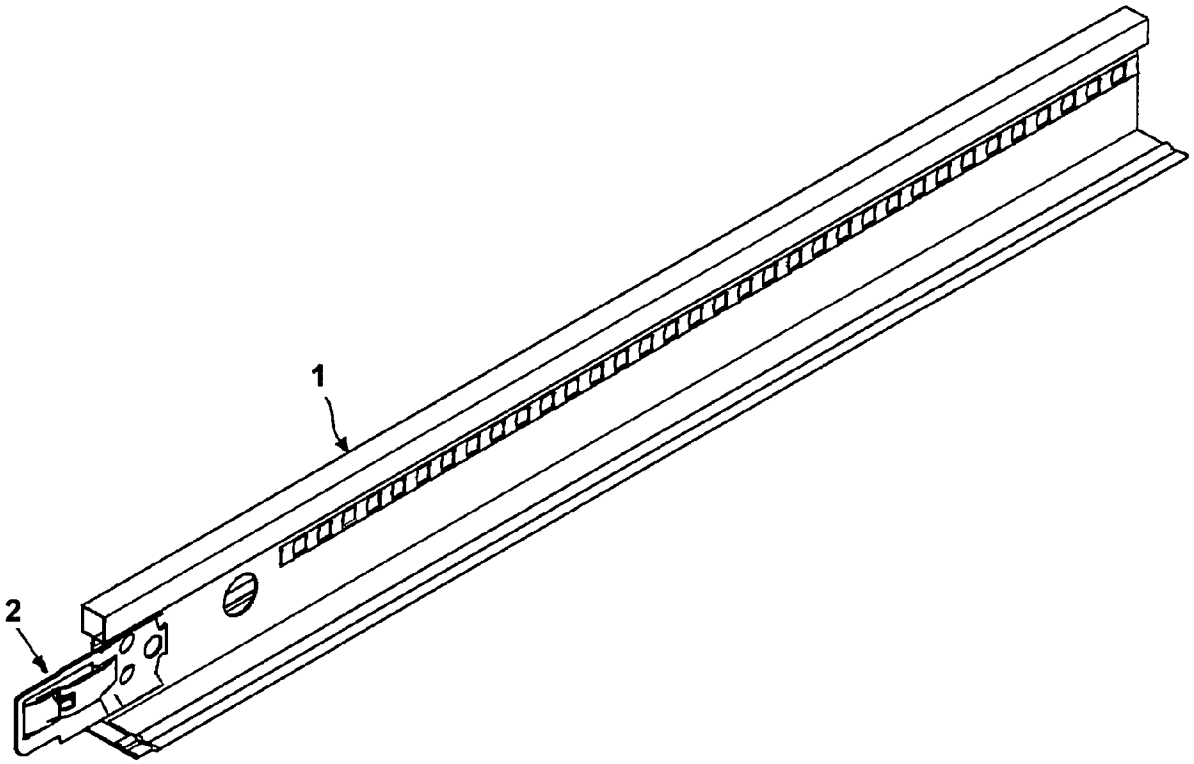
FIG. 8 shows a perspective view of a bar of a support structure for false ceilings according to a further embodiment of the present disclosure.

With respect to this longitudinal direction L, in the metal bar 1 it is possible to identify a transverse direction T (extending from a long side to the other long side of the bar, when viewing FIGS. 3 and 8) which traverses, crosses or intersects the longitudinal direction and which consequently extends from a base area 8 (first long side) of the metal bar 1 to a top area 7 (second long side) of the metal bar 1.

Such a transverse direction T may be understood as being a direction orthogonal to the longitudinal direction L or also be understood as being a direction extending obliquely and therefore forming an acute angle with the longitudinal direction L, in a short-side direction of the bar. The transverse direction T may be partially curved or completely curved.

According to one aspect of the present disclosure, at least one of the two sheet metal portions 5, 6 includes one or more half-cut areas, i.e. incomplete cut areas (such as to leave a joining zone), wherein the half-cut extends in the transverse direction T of the metal bar 1. More particularly, at least one of the two sheet metal portions 5, 6 includes one or more parts 10, 10A, 11, 11A partially sheared by means of a partial cut, i.e. by one or more cuts 9 which determines a shifting, with bending, of that part 10, 10A, 11, 11A of a sheet metal portion 5, 6 towards the other sheet metal portion 5, 6. Such a part 10, 10A, 11, 11A of a sheet metal portion 5, 6 is shifted so as to protrude and interfere with the other sheet metal portion 5.6. In other words, the partially cut part 10, 10A, 11, 11A of a sheet metal portion 6 is shifted so as to occupy a thickness zone of the other sheet metal portion 5, 6. In particular, the cuts 9 carried out in the transverse direction T are such as to determine a shifting or bending of the partially cut part 10, 10A, 11, 11A of at least one of the sheet metal portions 5, 6 towards the other sheet metal portion 5, 6, and a consequent projection towards the other sheet metal portion 5, 6.

It should be noted that the interference of a half-cut part with respect to the other sheet metal portion may occur along the whole of the cut 9, or only in a bending zone, for example in a corner zone of the half-cut part.

In practice, one of the two sheet metal portions 5, 6 includes a part 10, 10A, 11, 11A, which being partially cut, is shifted towards the other sheet metal portion 5, 6. It follows that the partially cut part 10, 10A, 11, 11A of one of the sheet metal portions 5, 6 is able to interfere with the other sheet metal portion 5, 6, and such interference occurs, or extends, mainly in a transverse direction T.

It is pointed out moreover that, in addition to the bending zone 12, each half-cut part 10, 10A, 11, 11A has an uncut central zone 13 joined to the remaining part of the metal sheet 5, 6. The central zone 13 of all the partially cut parts 10, 10A, 11, 11A defines a central line, which is a line of symmetry, for the partially cut parts 10, 10A, 11, 11A and which extends parallel to the longitudinal direction L.

According to one aspect of the present disclosure, the partially cut part 10, 10A, 11, 11A has, when viewed from a thickness side, or in perspective, or in vertical section, of the bar 1, a "curvilinear profile", namely a profile which is not straight, for example V-shaped, as shown in FIG. 5. In other embodiments, the partially cut part 10, 10A, 11, 11A has a W-shaped or concave C-shaped profile, or a variety of such profiles repeated in the transverse direction.

It can be seen that, in one embodiment of the present disclosure, such as the embodiment shown in the drawings, the central zone 13 coincides with a zone of maximum concavity, or curved zone, of the profile of the partially cut part 10, 10A, 11, 11A, for example with the tip zone of the V shape.

Owing to an interference in this transverse direction T, together with the aforementioned curvilinear profile, it is possible to minimize the possibility of torsion of the metal bar 1 about an axis parallel to the longitudinal direction L, compared to metal bars made of the same material and with the same thickness of sheet metal or other characteristics, such as the elastic limit and tensile strength. In other words, the extension of the cuts 9 in the transverse direction of the metal bar 1, together with the aforementioned curvilinear profile, determines the formation of half-sheared parts protruding, with a maximum interference owing to the curvilinear profile, in said transverse direction.

Such half-sheared parts therefore create projections, which are V-shaped and have a similar curvature, in the transverse direction and a consequent interference that is able to create an effective obstacle to relative slipping of the two sheet metal portions 5, 6, and consequently an effective impediment to torsion of the bar about an axis parallel to the longitudinal direction L (anti-torsion effect).

This interference, in addition to preventing relative slipping of the two sheet metal portions 5, 6, results in clinching together of the two sheet metal portions 5, 6 (anti-disengagement effect) such as to prevent also fortuitous disengagement of the sheet metal portions 5, 6.

In some embodiments, such as, by way of example, the one shown in FIGS. 1-5, each of the two sheet metal portions 5, 6 comprises the aforementioned cuts 9 defining the partially sheared parts 10, 10A, 11, 11A, i.e. obtained by means of a partial cut.

In particular, each sheet metal portion 5, 6 has pairs of adjacent cuts 9, wherein each of said pairs of cuts 9 defines the part 10, 10A, 11, 11A (half-sheared or half-cut part 10, 10A, 11, 11A).

Figure 2:
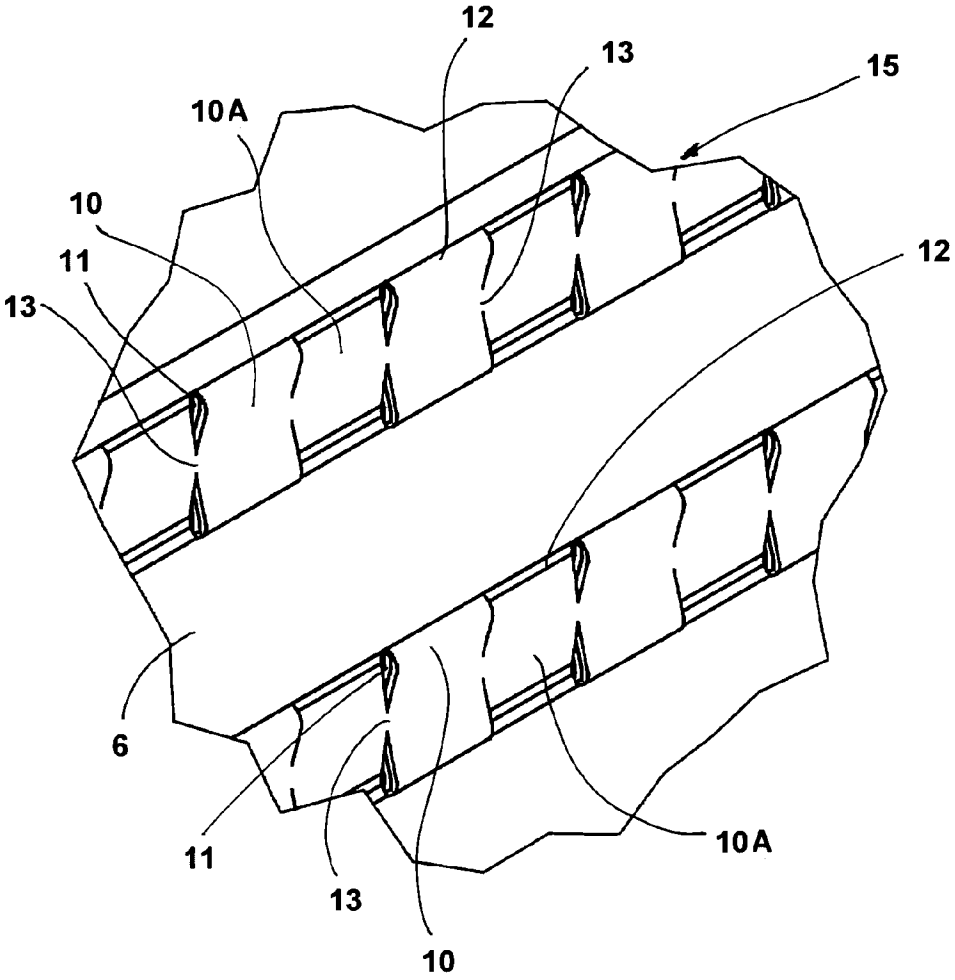
FIG. 2 shows a view of a detail II of FIG. 1.

In the example of embodiment in FIGS. 1-5, the pairs of cuts 9 of one of the two sheet metal portions 5, 6 alternate (are staggered) with respect to the pair of cuts of the other of the two sheet metal portions. In other words, the cuts 9 are made in pairs, alternatively on one side and on the other side of the bar, so as to form pairs of staggered cuts. In practice, in some embodiments, such as those illustrated, the two sheet metal portions 5, 6 have pairs of adjacent/staggered cuts in said longitudinal direction L and on opposite sides. Such cuts 9 determine an alternate shifting in opposite directions of overlapped pairs of partially cut parts, as can be seen in FIG. 2 and FIG. 5. This alternate shifting enables an increased interference between the parts to be obtained.

Figure 4A:
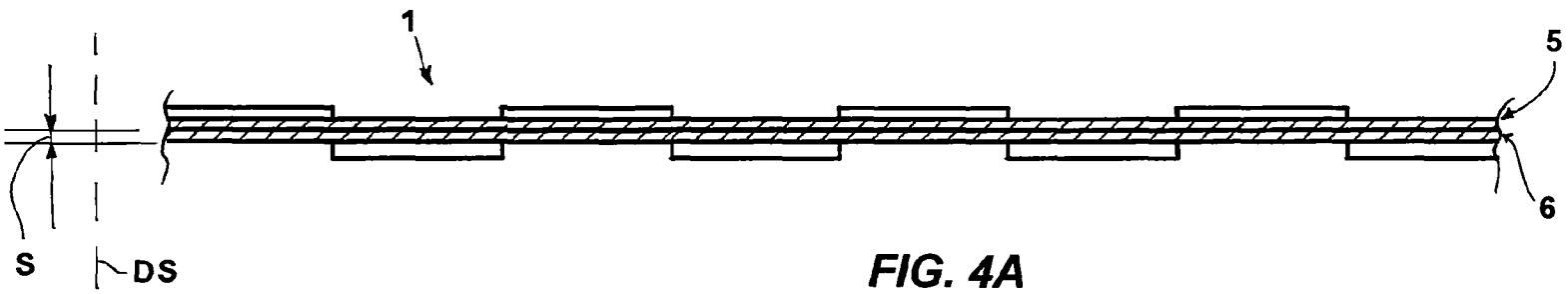
FIG. 4A shows a longitudinal section along the line IVA-IVA of FIG. 3.
Figure 4B:
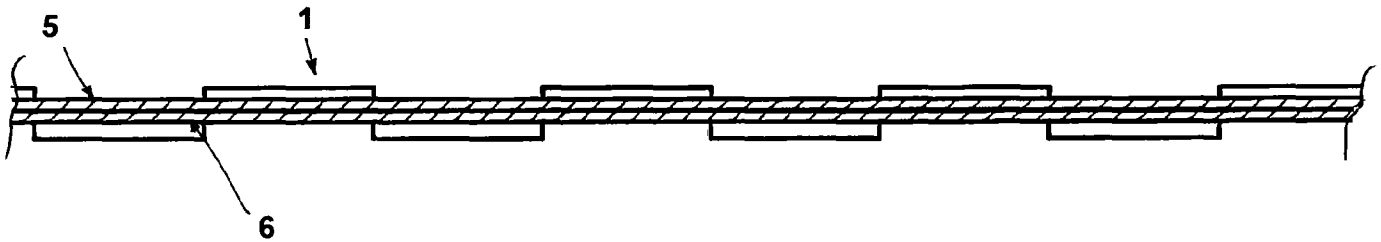
FIG. 4B shows a longitudinal section along the line IVB-IVB of FIG. 3.
Figure 4C:
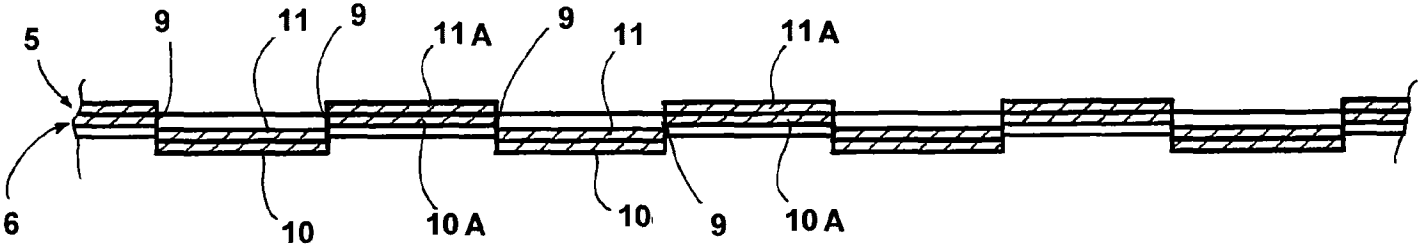
FIG. 4C shows a longitudinal section along the line IVC-IVC of FIG. 3.

It follows that, with reference to FIGS. 4A, 4B, 4C and 5, according to some aspects of the present disclosure, each of said sheet metal portions 5, 6 has a thickness S such that a direction which crosses the thickness S is a thickness direction DS. The partially cut parts 10, 10A, 11, 11A of FIG. 4*c* are overlapped in said thickness direction DS and are shifted in pairs in the thickness direction DS with respect to an adjacent area of the respective sheet metal portion 5, 6. In particular, the partially cut parts 10, 10A, 11, 11A are shifted in pairs in the thickness direction DS and one of the partially shifted parts 10A, 11A is protruding towards the outside with respect to said thickness S and defines a free area in said thickness S. The other of said partially cut parts 10, 11, with the respective curved profile, is arranged at least partially in the free area of the thickness S of the one sheet metal portion 5, 6, so as to create the interference in the longitudinal direction and in the transverse direction. Such interference allows a satisfactory anti-torsion action to be obtained.

It may be noted that, in the exemplary embodiment of FIGS. 1-5, the pairs of parts 10, 11A and 11, 10A follow one another adjacent without interruption in the bar 1. In practice the cuts 9 are in each case common to two pairs of half-cut parts which are adjoining in the sequence.

Figure 12:
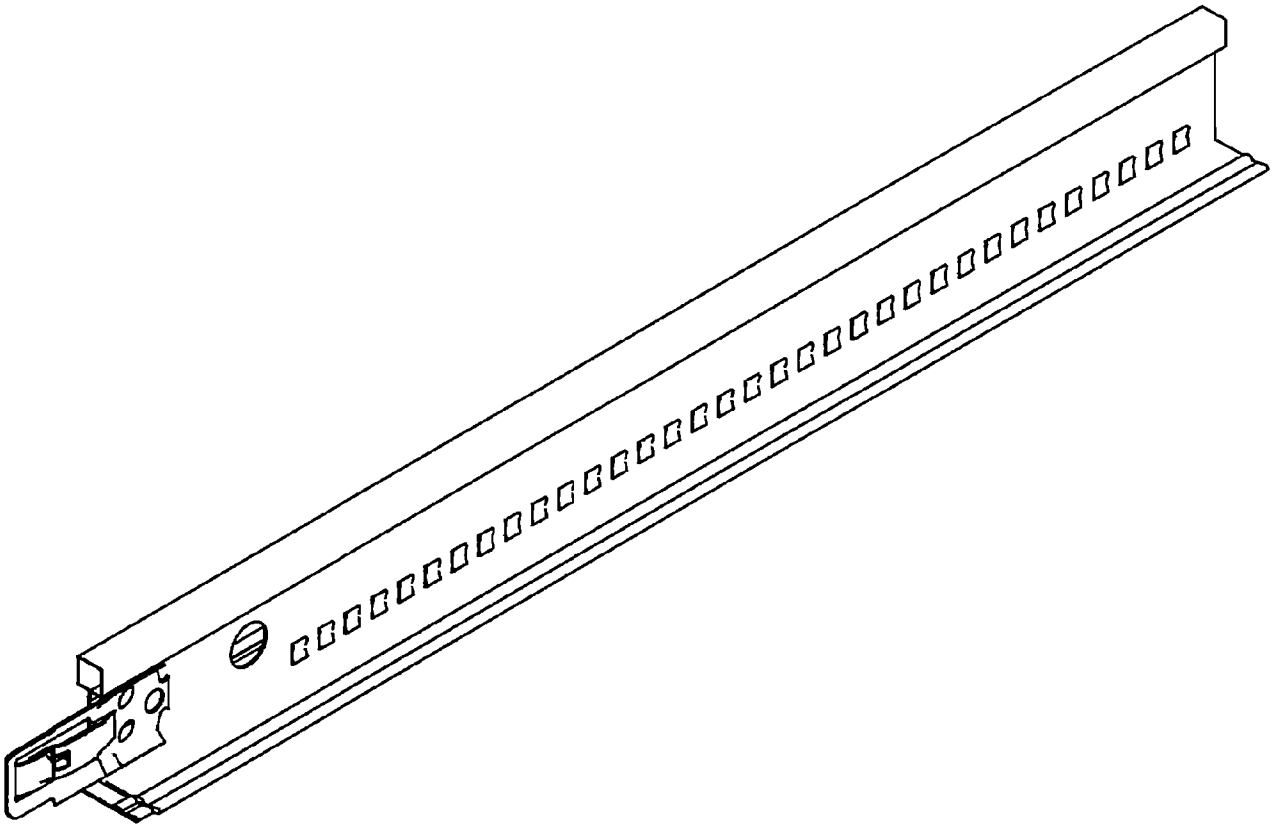
FIG. 12 shows a perspective view of a bar of a support structure for false ceilings according to a further embodiment of the present disclosure.
Figure 13:
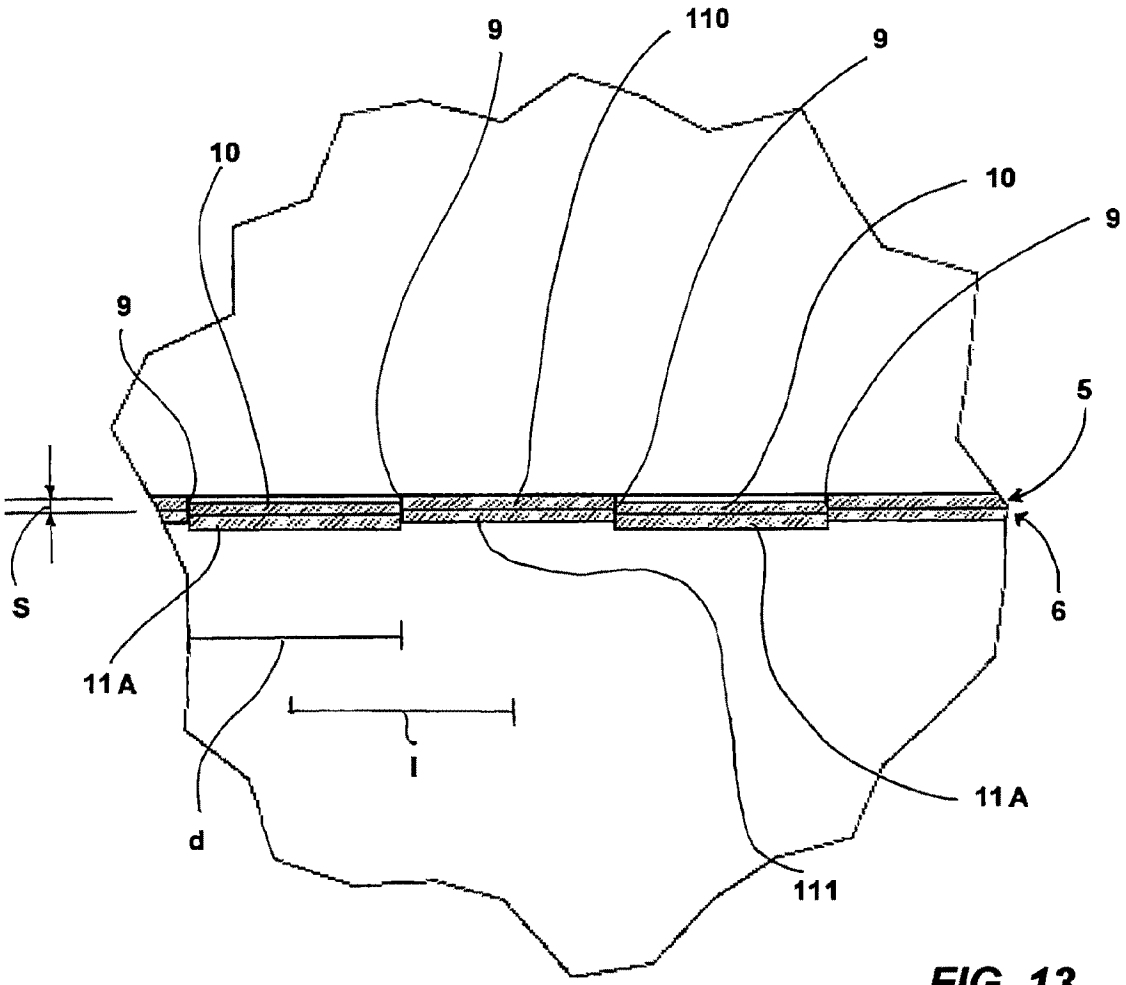
FIG. 13 shows a longitudinally sectioned view of the bar shown in FIG. 12.

In some embodiments, such as those illustrated in FIGS. 12 and 13, only one of the two sheet metal portions 5, 6 includes the cuts 9 defining the partially cut parts 10 (sheared by a partial cut) which determine a shifting and possible cut of a corresponding part 11A of the other sheet metal portion.

In particular, a single sheet metal portion 5, 6 has one or more, for example pairs of adjacent cuts 9, wherein each of said pairs of cuts 9 defines pairs of parts. For example, the pairs of cuts 9 of one of the two sheet metal portions 5, 6 are made at intervals along the longitudinal direction at a constant pitch, or with a given pitch, so as to define a plurality of pairs of cuts 9. In practice, it can be noted that the pairs of parts 10, 11A follow one another spaced at regular intervals. Owing to the geometry of the parts described above, the pairs of parts 10, 11A alternate with parts 110, 111 of the two sheet metal portions 5, 6 which are not cut, i.e. have not been worked.

The spacing between successive pairs 10, 110, 11A, 111, denoted by I in FIG. 13 corresponds, for example, to the mutual distance d between the two cuts 9 of each pair. In other words, pairs of cuts 9 are made only on one side of the bar, at more or less regular intervals. In this embodiment, the cuts 9 determine a shift in the same direction of the parts 10, 11A.

It follows that, with reference to FIG. 13, according to some aspects of the present disclosure, each of said sheet metal portions 5, 6 has a thickness S such that a direction which crosses the thickness S is a thickness direction DS. The partially cut parts 10, 11A of FIG. 13 are overlapped in said thickness direction DS and are shifted in pairs in the thickness direction DS with respect to an adjacent area of the respective sheet metal portion 5, 6. In particular, the partially cut parts 10, 11A are shifted in pairs in the thickness direction S and one of the partially shifted parts 11A is protruding towards the outside with respect to said thickness S and defines a free area in said thickness S. The other of said parts 10 is arranged at least partially in the free area of the thickness S, so as to create interference between the sheet metal portions 5, 6.

Figure 14:
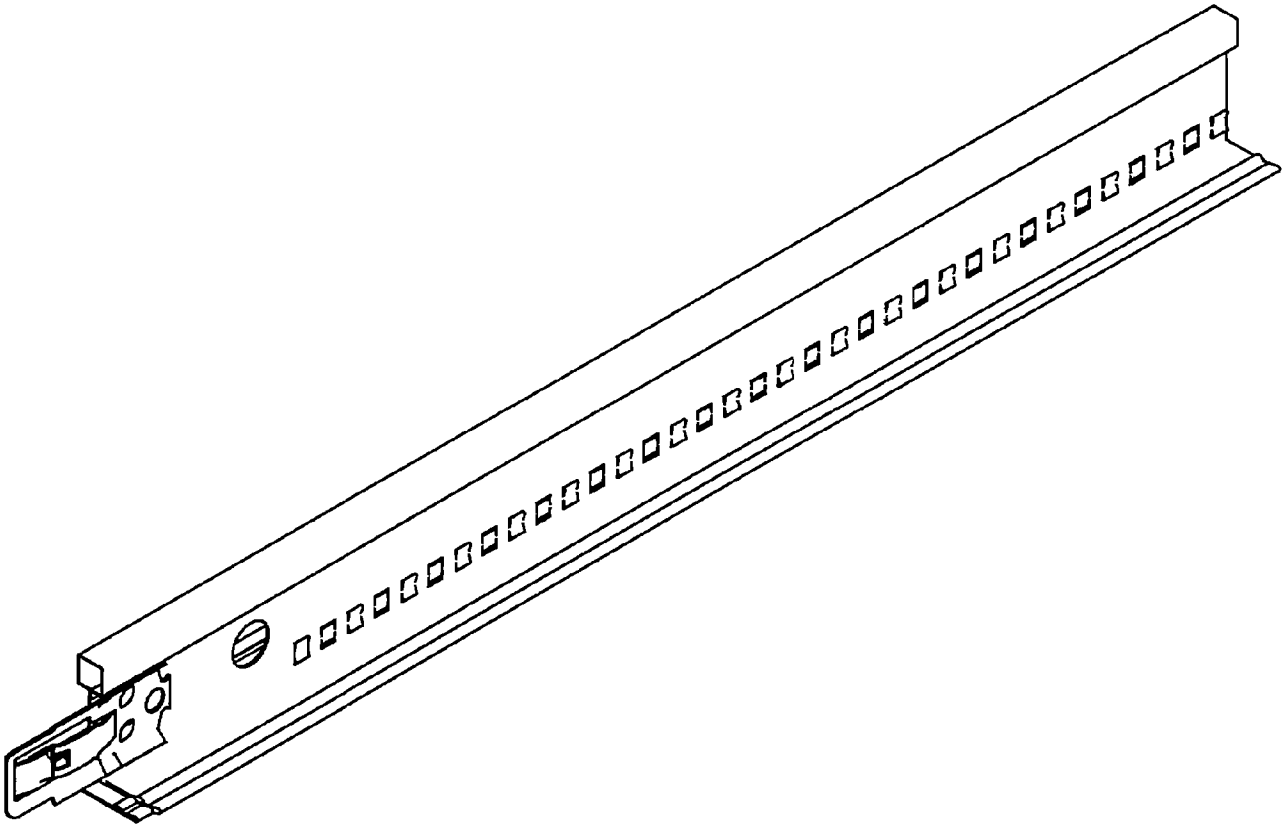
FIG. 14 shows a perspective view of a bar of a support structure for false ceilings according to a further embodiment of the present disclosure.

In other embodiments, such as that shown in FIG. 14, it is also possible to provide a combination of the two preceding embodiments, wherein the pairs of cuts 9 may be made at intervals along the longitudinal direction at a constant pitch, or with a given pitch, as in the embodiment of FIG. 13 and, at the same time, alternatively on the one and on the other sheet metal portion 5, 6 as in the embodiment of FIGS. 1-5.

It follows that, in some embodiments, the cuts 9 define a sequence or series of half-cut parts 10, 10A, 11, 11A, which alternate continuously or at intervals, so as to form a half-cut line. Such a half-cut line is also called, by analogy of ideas, a seam line or seam.

Figure 7:
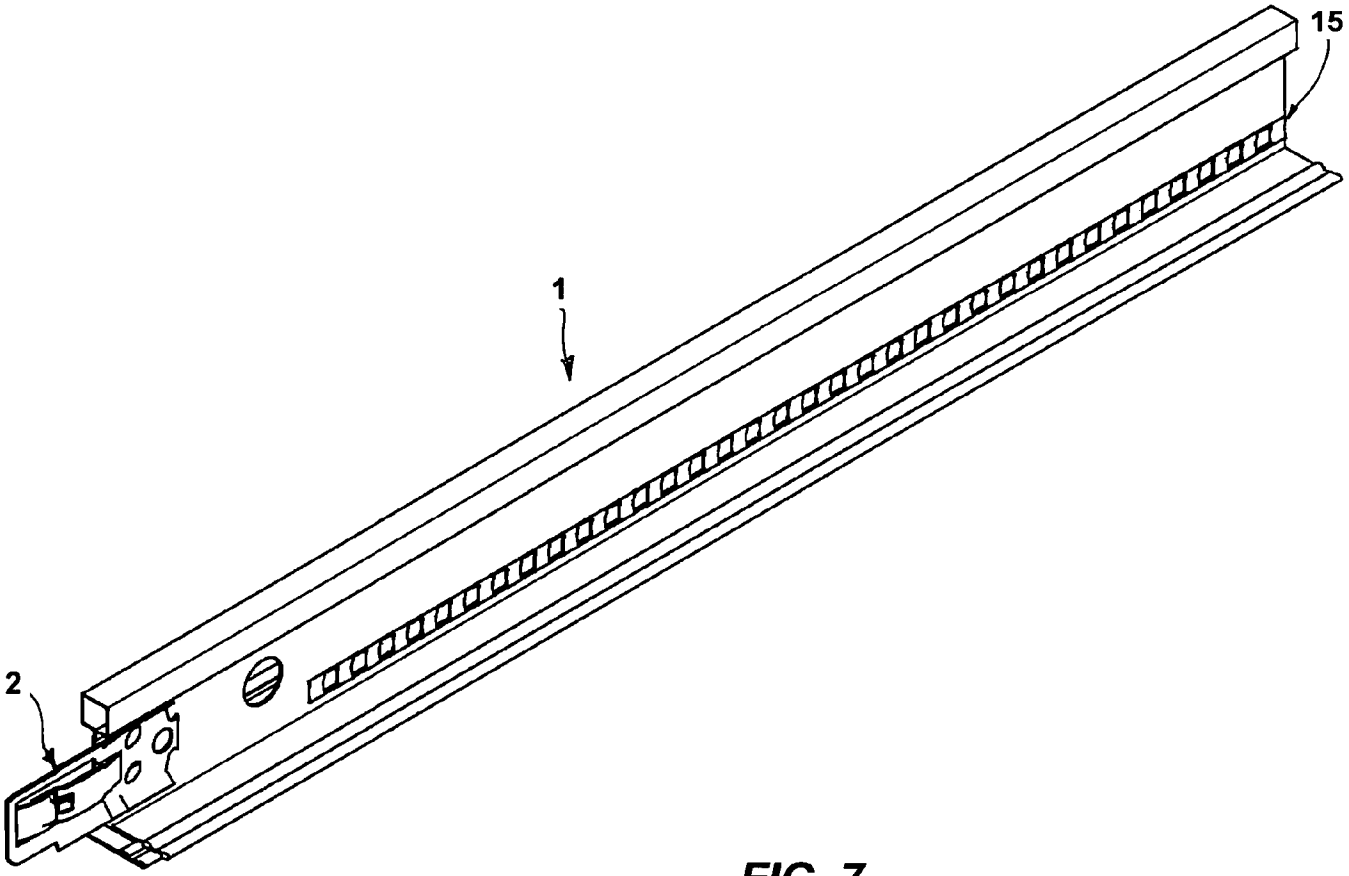
FIG. 7 shows a perspective view of a bar of a support structure for false ceilings according to a further embodiment of the present disclosure.

The seam line 15 or half-cut line may be in turn continuous, as shown in FIG. 1, FIG. 7 and FIG. 8, or may be a discontinuous line, or a broken line, as shown in FIGS. 6 and 9 and FIGS. 18-20.

Figure 17:
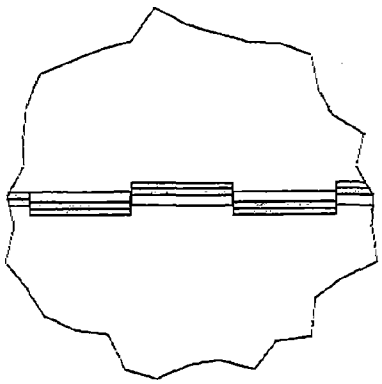
FIGS. 15-17 show longitudinally sectioned views of a bar according to a corresponding number of embodiments of the present disclosure.
Figure 16:
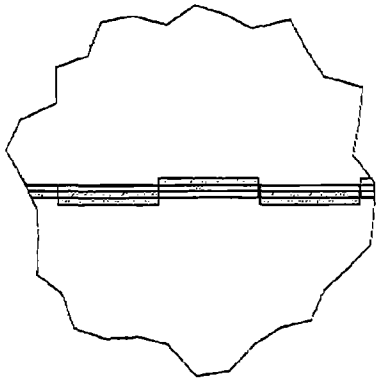
Figure 15:
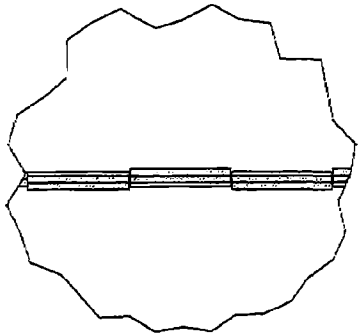
Figure 18:
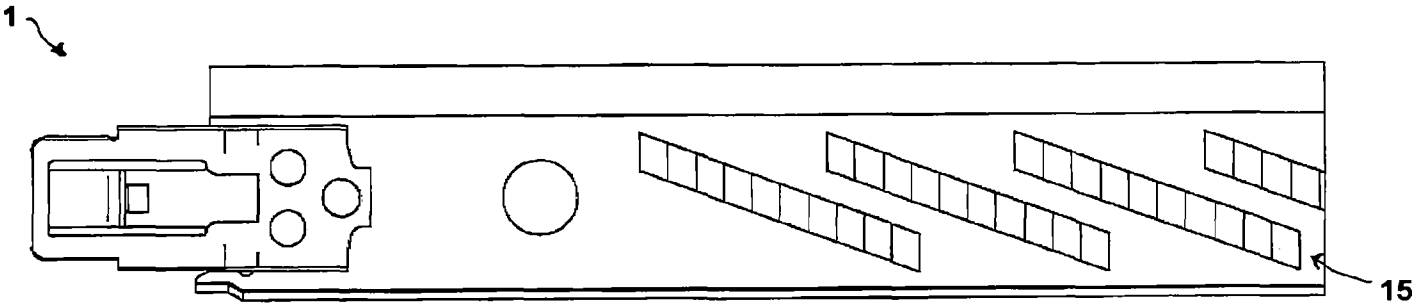
FIGS. 18-23 show respective perspective views of bars for a support structure for false ceilings, according to further embodiments of the present disclosure.
Figure 19:
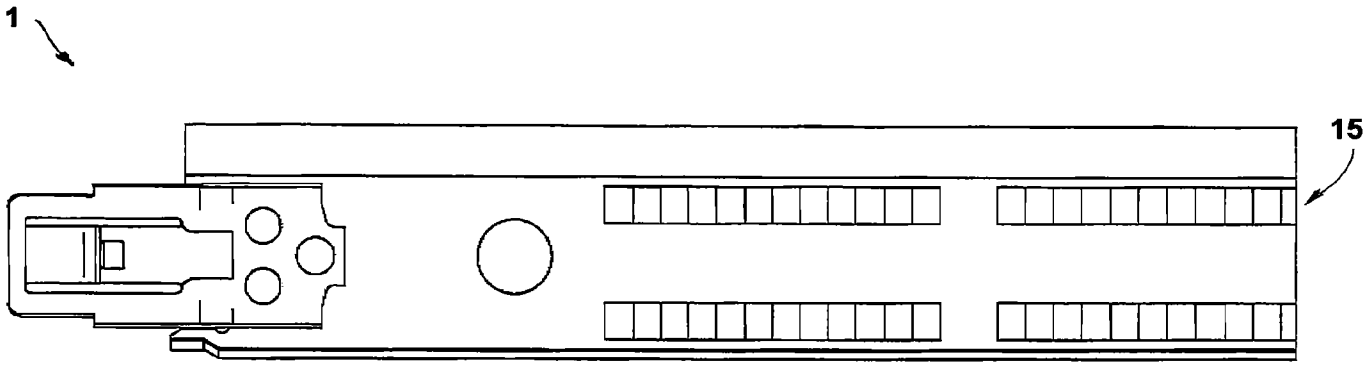
Figure 20:
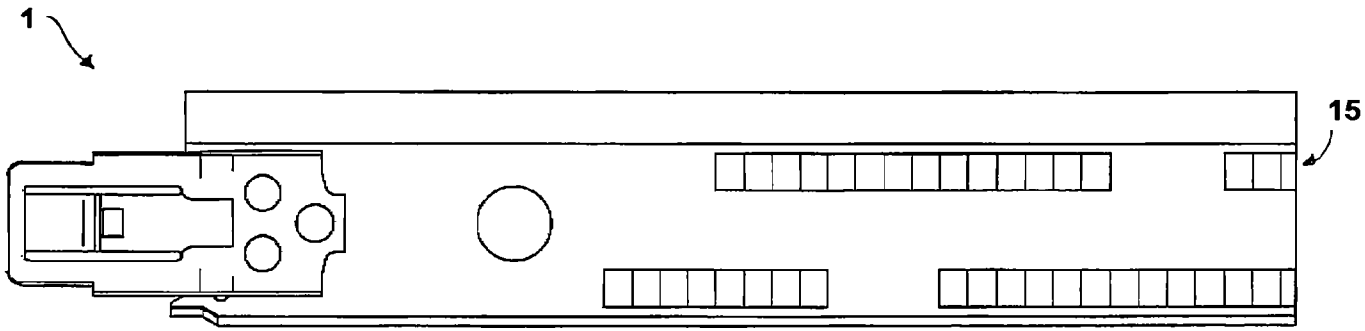
Figure 21:
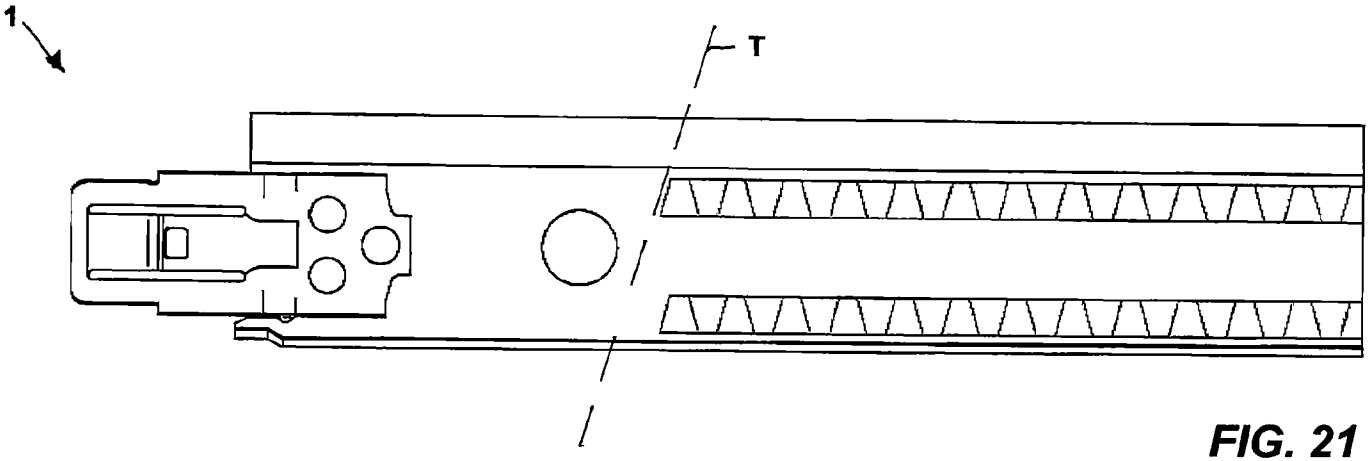
Figure 22:
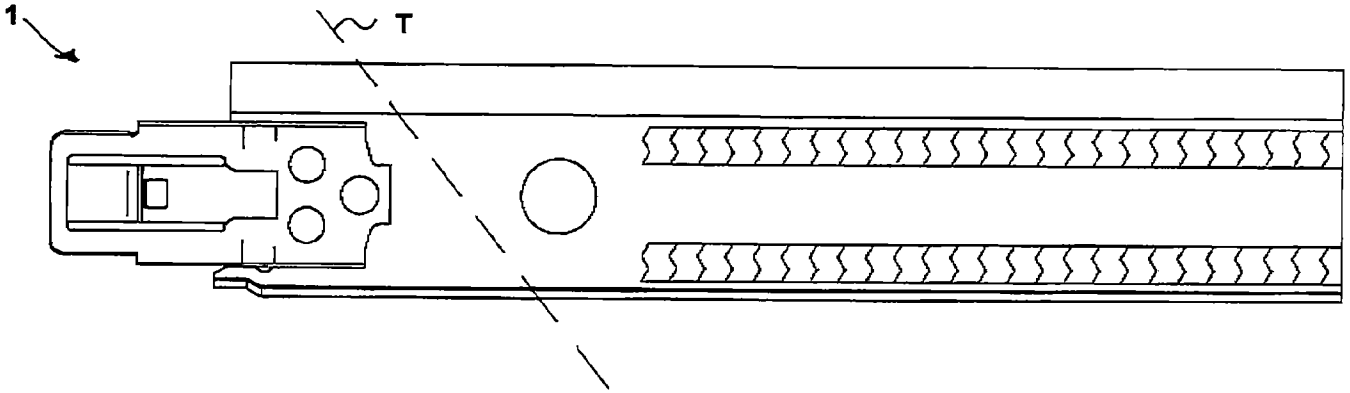
Figure 23:
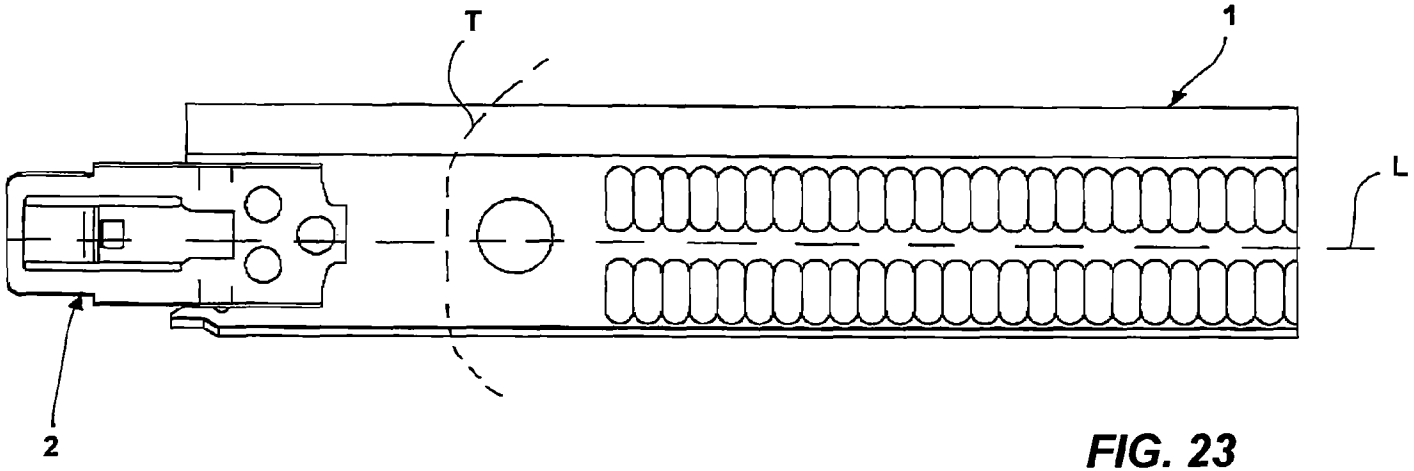

Furthermore, according to further aspects of the present disclosure, the metal bar 1 may include two or more series or half-cut lines 15 arranged on two different levels in said transverse direction, comprised between the base area 8 and the top area 7, as shown by way of example in FIG. 17 or FIG. 18.

Even more particularly, in order to adjust and control a degree of interference between the first sheet metal portion 5 and the second sheet metal portion 6, it is possible, for each of the embodiments of the present disclosure such as those described above or a combination thereof, to adjust the depth of cut 9 with respect to the thickness S or height of the sheet metal portion 5, 6 of the bar.

It is to be understood that the depth or penetration of the cut 9 with respect to the thickness is chosen according to the interference capacity (and therefore the anti-torsion capacity) of the two sheet metal portions 5, 6 which is to be obtained and depends on the thickness of each sheet metal portion 5, 6, on the material of the sheet metal portion 5, 6, on its elastic limit and on its tensile strength, or on the presence of possible surface machining on the faces of the sheet metal portions 5, 6.

A working process for working a metal bar 1 according to an exemplary embodiment of the present disclosure is illustrated below. Such process may be used to make any of the bars described above.

A metal bar 1 is provided with for example a T-shaped section or another section and is obtained by bending a metal sheet, so as to have a pair of portions or sheet metal walls 5, 6 which are overlapped.

One, both, or more, portions or sheet metal walls 5, 6 are subjected to a partial cut by means of a device known to a person skilled in the art, suitable for making partial cuts in sheet metal. In particular, a punch with a head having a profile which is not straight, for example V-shaped or W-shaped or in the shape of a concave C, or a variety of these shapes which are repeated in the transverse direction, is used.

The partial cut is performed so as to make staggered pairs of cuts 9 on opposite sides of the two sheet metal portions 5, on the one of the two sheet metal portions 5, 6 towards the other of the two sheet metal portions 5, 6, such as those visible in FIG. 5, or pairs of cuts 9 at regular distances on only one of the two sheet metal portions 5, 6, or cuts as in any one of the embodiments of FIGS. 12 and 13. These cuts 9 extend, i.e. are directed, in the transverse direction T of the metal bar 1. The half-cut parts, when viewed in the thickness direction DS, have a profile which is not straight, for example V-shaped or W-shaped or with a concave C-shape, or with a variety of such shapes which are repeated in the transverse direction.

The curvilinear profile may also be a sinusoidal profile.

Figure 11:
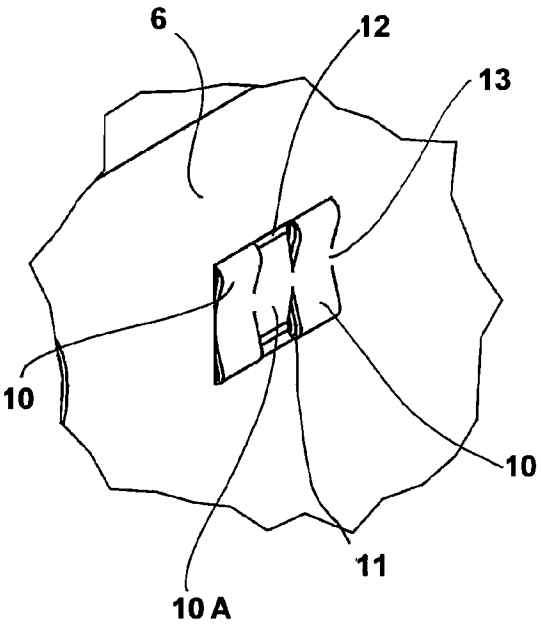
FIG. 11 shows a view, on a larger scale, of a detail of a bar according to an embodiment of the present disclosure, which is an alternative to the detail in FIG. 10.
Figure 10:
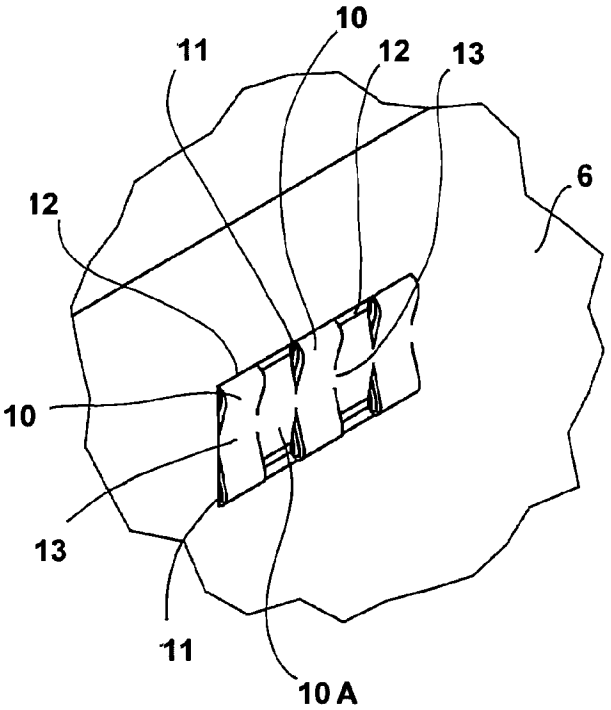
FIG. 10 shows a view, on a larger scale, of a detail X of FIG. 9.

More particularly, the half-cut is made so as to define pairs of half-cut parts 10, 10A, 11, 11A, which in the exemplary embodiment of FIGS. 1 to 5 alternate continuously in the longitudinal direction and pairs of parts 10, 11 which in the exemplary embodiment of FIG. 10 or 11 are arranged at regular intervals in the longitudinal direction. Owing to the half-cut in the transverse direction an intersection in the transverse direction and in the longitudinal direction between the two sheet metal portions 5, 6 is produced, thus preventing relative sliding of said portions.

Figure 9:
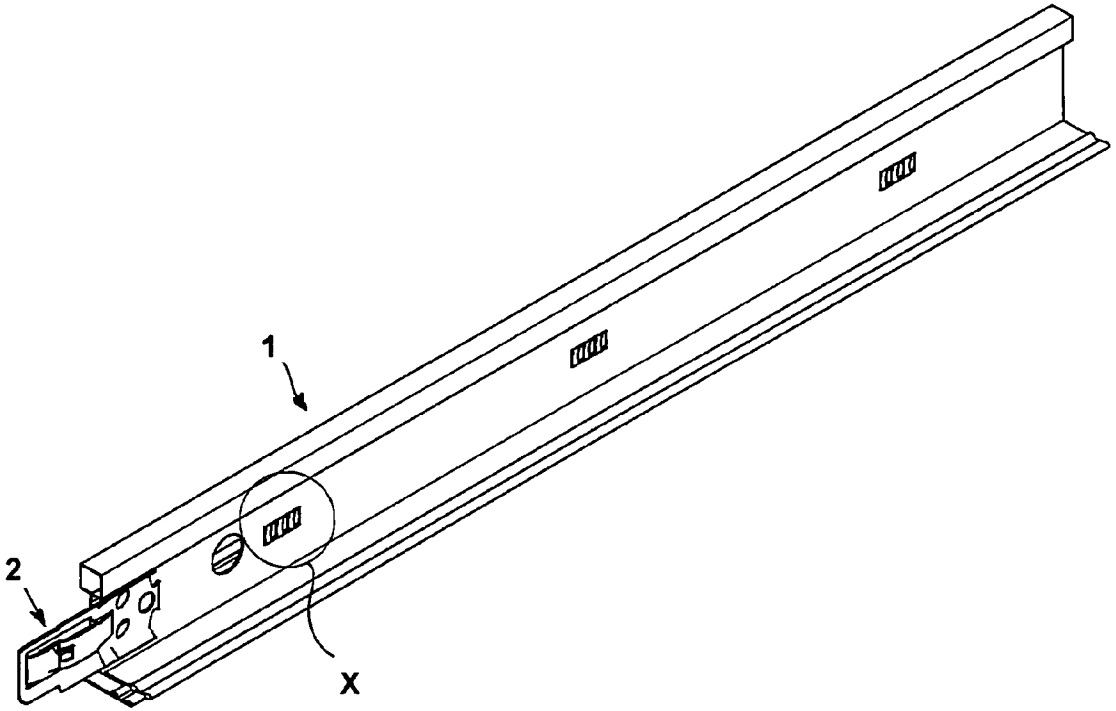
FIG. 9 shows a perspective view of a bar of a support structure for false ceilings according to a further embodiment of the present disclosure.

More particularly, with reference to FIGS. 9 to 11, it should be noted that, according to one aspect of the present disclosure, in order to obtain an effective interference between the sheet metal portions and the aforementioned "anti-torsion" effect and "anti-disengagement" effect between the metal portions, it is preferable to make at least three, or even better five, cuts 9 in succession along the bar so as to obtain at least two, or four, half-cut parts 10, 10A, 11, 11A in sequence along the bar 1.

It should be noted, moreover, that the shape of the parts 10, 10A, 11, 11A, when viewed from one side of the bar 1 is substantially rectangular. This shape is not to be considered essential for the present disclosure. Many forms or different shapes of half-sheared parts may be provided. It is important that the half-cut is performed to art, making sure that any play resulting from machining is very small and that interference between the parts is ensured.

In accordance with further embodiments, not shown, instead of the clip 2, the bar includes an integral engaging element located at one end of the bar and forming an integral part of the bar.

The cuts 9 according to the present disclosure may be performed in the integral engaging element so as to connect together by means of mutual clinching the sheet metal portions which define the integral engaging element and prevent mutual separation and opening of the sheet metal portions, which would result in the integral engaging element being unutilizable.

The subject-matter of the present disclosure has been described hitherto with reference to preferred embodiments thereof. It is understood that there may be other embodiments which relate to the same inventive concept, all falling within the protective scope of the claims set forth hereinafter.

The invention claimed is:

1. A bar for a support structure of a false ceiling, said bar being elongated in a longitudinal direction and including at least two sheet metal portions located side by side or overlapping, in contact, or adherent, with each other along said longitudinal direction, in a long-side direction, wherein, in said bar, a transverse direction, in a short-side direction, extending transverse to, or intersecting, said longitudinal direction, is defined, wherein both the sheet metal portions have cuts which are arranged, are directed, or extend, along said transverse direction, said cuts define partially cut parts wherein a single cut is common for two pairs of partially cut parts, pairs of partially cut parts of the sheet metal portions being overlapped and shifted in pairs in a thickness direction with respect to an adjacent area of the respective sheet metal portion, and wherein, of each pair of partially cut parts overlapped and shifted in the thickness direction, a part of a sheet metal portion is protruding outwards with respect to said thickness and defines a free zone in said thickness, and at least a concave or curved profile of the other partially cut part of the other of said sheet metal portions is arranged at least partially in said free zone of the thickness of the one sheet metal portion, creating an interference between the two sheet metal portions in the transverse direction, wherein said partially cut parts have along said transverse direction and, when viewed in perspective, a profile which is at least partially curvilinear or concave, and wherein each partial cut has an uncut central zone defining a central line intersecting said partial cuts.

2. The bar according to claim 1, wherein said curvilinear or concave profile is V-shaped or W shaped or with a concave C-shape or has a variety of said curvilinear shapes which are repeated in the transverse direction.

3. The bar according to claim 1, wherein said curvilinear or concave profile is symmetrical with respect to said central line.

4. The bar according to claim 1, wherein the central zone coincides with a zone of maximum concavity, or maximum bending or curvature, of the curvilinear or concave profile.

5. The bar according to claim 1, wherein the pairs of said partially cut parts alternate along said longitudinal direction, wherein a first pair of said partially cut parts is in a shifted condition towards the one sheet metal portion, and wherein a second pair of said partially cut parts is in a shifted condition towards the other sheet metal portion.

6. The bar according to claim 5, wherein the pairs of said partially cut parts are distributed along said longitudinal direction, wherein the first pair of said partially cut parts shifted towards the one sheet metal portion is adjacent and in contact with the second pair of said partially cut parts shifted towards the other sheet metal portion.

7. The bar according to claim 5, wherein at least two or four partially cut parts of the two sheet metal portions are arranged in sequence along the longitudinal direction.

8. The bar according to claim 5, wherein said cut parts are adjoining in sequence.

9. A support structure for a false ceiling including the metal bar according to claim 1.

10. The bar according to claim 1, wherein said cuts define sides extending along the transverse direction of the partially cut portion.

11. Working process for working a metal bar, wherein the process comprises the steps of:

providing a bar elongated along a longitudinal direction or long side and including at least two sheet metal portions located side by side in contact with each other along said longitudinal direction, cutting at least partially at least one of said sheet metal portions in a transverse direction, or short side, transverse with respect to, or intersecting, said longitudinal direction, so as to define a partially cut part along said transverse direction, wherein a single cut is common for two pairs of partially cut parts, wherein both said sheet metal portions are cut, such that pairs of partially cut parts of the sheet metal portions are overlapped and shifted in pairs in the thickness direction with respect to an adjacent zone of the respective sheet metal portion, and so that, of each pair of partially cut parts overlapped and shifted in pairs in the thickness direction, a part of a sheet metal portion projects outwardly with respect to said thickness and defines a free zone in said thickness and at least a concave or curved profile of the other partially cut part of the other of said sheet metal portions is arranged at least partially in said free zone of the thickness of the one sheet metal portion, creating an interference between the two sheet metal portions in the transverse direction;

wherein the partially cut parts have along said transverse direction and, when viewed in perspective, a profile which is at least partially curvilinear or concave, and wherein the parts are partially cut by a partial cut so as to have an uncut central zone defining a central line intersecting said partial cuts.

12. Process according to claim 11, wherein the parts are partially cut by means of a punch with a head having a profile which is curvilinear, V-shaped, W-shaped or with a concave C-shape or has a variety of said curvilinear shapes which are repeated in the transverse direction.

13. Process according to claim 11, wherein the central joining line extends parallel to said longitudinal direction.

14. Process according to claim 11, wherein a first pair of cuts is made on a first sheet metal portion so as to form a first pair of partially cut parts and a second pair of cuts is made on the other sheet metal portion so as to form a second pair of partially cut parts, so that said first pair and said second pair of partially cut parts alternate and are adjacent in the longitudinal direction and shifted alternately towards the one of said of said sheet metal portions and towards the other of said sheet metal portions.

15. Process according to claim 11, wherein said cuts define sides extending along the transverse direction of the partially cut portion.

* * * * *